US008628389B2

(12) United States Patent
Hannam et al.

(10) Patent No.: US 8,628,389 B2
(45) Date of Patent: Jan. 14, 2014

(54) WORKSTATION SYSTEM

(75) Inventors: Robert Hannam, Camp Mountain (AU); Nicky Paul Scriggins, Ashgrove (AU)

(73) Assignee: OFI Investments Pty. Ltd., Queensland (AU)

( * ) Notice: Subject to any disclaimer, the term of this patent is extended or adjusted under 35 U.S.C. 154(b) by 596 days.

(21) Appl. No.: 12/084,183

(22) PCT Filed: Oct. 26, 2006

(86) PCT No.: PCT/AU2006/001598

§ 371 (c)(1),
(2), (4) Date: Jun. 26, 2009

(87) PCT Pub. No.: WO2007/048194

PCT Pub. Date: May 3, 2007

(65) Prior Publication Data

US 2010/0050662 A1 Mar. 4, 2010

(30) Foreign Application Priority Data

Oct. 27, 2005 (AU) ..... 2005905950

(51) Int. Cl.
*F24F 7/00* (2006.01)

(52) U.S. Cl.
USPC ..... 454/185

(58) Field of Classification Search
USPC ..... 454/184–186, 267, 271, 276, 289, 292; 62/427
See application file for complete search history.

(56) References Cited

U.S. PATENT DOCUMENTS

| | | | | | |
|---|---|---|---|---|---|
| 1,844,635 | A | * | 2/1932 | Caller | 406/88 |
| 2,205,716 | A | * | 6/1940 | Dunham et al. | 165/281 |
| 2,277,247 | A | * | 3/1942 | Morse | 237/49 |
| 2,642,270 | A | * | 6/1953 | Hollingsworth et al. | 165/54 |
| 2,663,244 | A | * | 12/1953 | MacDowell | 454/266 |
| 2,721,033 | A | * | 10/1955 | Elliott | 237/48 |
| 2,738,171 | A | * | 3/1956 | Walton | 165/41 |
| 2,988,980 | A | * | 6/1961 | Tschudin | 454/296 |
| 3,498,032 | A | * | 3/1970 | Scott | 55/471 |
| 3,596,936 | A | * | 8/1971 | Dieckmann et al. | 285/222.1 |
| 3,605,797 | A | * | 9/1971 | Dieckmann et al. | 137/375 |
| 3,789,747 | A | * | 2/1974 | Wasserman et al. | 454/186 |
| 4,019,429 | A | * | 4/1977 | Sado | 454/276 |
| 4,351,475 | A | * | 9/1982 | Hudson | 237/46 |
| 4,378,727 | A | * | 4/1983 | Doss | 454/251 |
| 4,625,633 | A | * | 12/1986 | Martin | 454/49 |
| 4,646,966 | A | * | 3/1987 | Nussbaum | 237/49 |
| 4,784,445 | A | * | 11/1988 | Ott | 312/236 |

(Continued)

FOREIGN PATENT DOCUMENTS

| | | |
|---|---|---|
| JP | 4-70950 | 6/1992 |
| JP | 8-42911 | 2/1996 |

(Continued)

*Primary Examiner* — Steven B McAllister
*Assistant Examiner* — Jamil Decker
(74) *Attorney, Agent, or Firm* — Dilworth & Barrese, LLP.

(57) ABSTRACT

This invention resides in a workstation system comprising at least one work area and at least one partition adjacent the work area. The partition having a plurality of demountable screens, at least one of the screens having a cavity fluidly connected to at least one aperture in the partition. A conduit having one end fluidly connected to the cavity and an opposite end fluidly connected to an air duct to communicate air from the air duct to the aperture.

24 Claims, 7 Drawing Sheets

(56) References Cited

U.S. PATENT DOCUMENTS

| | | | | | |
|---|---|---|---|---|---|
| 4,860,642 | A | * | 8/1989 | Nussbaum | 454/306 |
| 4,872,397 | A | * | 10/1989 | Demeter et al. | 454/229 |
| 4,942,805 | A | * | 7/1990 | Hellwig et al. | 454/184 |
| 4,974,915 | A | * | 12/1990 | Bussard | 312/236 |
| 5,065,668 | A | * | 11/1991 | Mitchell et al. | 454/57 |
| 5,074,116 | A | * | 12/1991 | Kadotani et al. | 62/3.2 |
| 5,135,436 | A | * | 8/1992 | Levy et al. | 454/306 |
| 5,151,063 | A | * | 9/1992 | Tanaka et al. | 454/258 |
| 5,180,332 | A | * | 1/1993 | Mitchell et al. | 454/230 |
| 5,207,615 | A | * | 5/1993 | Edmisten | 454/322 |
| 5,238,452 | A | * | 8/1993 | Levy et al. | 454/306 |
| 5,267,895 | A | * | 12/1993 | Mitchell et al. | 454/57 |
| 5,314,212 | A | * | 5/1994 | Sanders | 285/197 |
| 5,322,473 | A | * | 6/1994 | Hofstra et al. | 454/186 |
| 5,358,444 | A | * | 10/1994 | Helm et al. | 454/306 |
| 5,403,232 | A | * | 4/1995 | Helm et al. | 454/230 |
| 5,722,483 | A | * | 3/1998 | Gibson | 165/54 |
| 5,743,054 | A | | 4/1998 | Luchetti et al. | |
| 6,261,174 | B1 | * | 7/2001 | Kuehn | 454/290 |
| 6,286,275 | B1 | * | 9/2001 | Edwards | 52/238.1 |
| 6,318,113 | B1 | * | 11/2001 | Levy et al. | 62/426 |
| 7,331,852 | B2 | * | 2/2008 | Ezell et al. | 454/229 |
| 2011/0097989 | A1 | * | 4/2011 | McQueeny et al. | 454/289 |

FOREIGN PATENT DOCUMENTS

| | | |
|---|---|---|
| JP | 2000-161760 | 6/2000 |
| WO | 89/10078 | 11/1989 |
| WO | WO92/01893 | 2/1992 |
| WO | WO96/41993 | 12/1996 |

* cited by examiner

WORKSTATION SYSTEM

FIELD OF THE INVENTION

The present invention relates to a workstation system. In particular, the invention relates to a reconfigurable workstation system that incorporates a climate control system.

DESCRIPTION OF THE PRIOR ART

The majority of office blocks are open plan with workstations often used to accommodate office workers within office blocks. While workstations are convenient for facilitating suitable work areas, there are a number of problems with present workstations that require addressing.

One problem relates to the combination of permanently fixed climate control systems and locations of workstations. Since climate control systems are installed while a building is under construction, outlets of the climate control systems are often positioned in areas assumed appropriate, often well before the introduction of workstations into the office block. Consequently, major fluctuations of temperatures within a single office block often occur, which in turn adversely affect the occupants of the workstations and general work output from the office.

Often workstations are located in open planned areas at specific locations dictated by the needs of the business. As such, a major drawback to present workstations is the failure to efficiently and effectively utilise existing climate control systems within an office block.

One attempt to overcome this problem is disclosed in U.S. Pat. No. 6,318,113 (Levy et al.), which refers to a personalised air-conditioned system. The document discloses a system having a below floor air chamber and an air terminal adjacent to the floor. Each air terminal includes a fan that directs air-flow from the air chamber through a flexible air tube into a designated work area. This arrangement is considered severely limiting since the majority of existing office buildings would require installation of below floor air chambers. Furthermore, fans in each air terminal produce distracting sounds that would affect the general ambience of the work area.

Similar systems that direct air from below a floor to a designated work area have been disclosed in U.S. Pat. No. 5,135,436 (Levy et al.), WO 96/41993 (Wyon) and WO 92/01893 (Collier).

Another attempt in efficiently utilising existing climate control systems within office blocks is disclosed in U.S. Pat. No. 5,358,444 (Helm et al.). The document discloses a ventilation system adapted to suit a furniture unit. The system comprises a conduit fixed onto the furniture unit and a collection/distribution unit with an overhead duct positioned over the collection/distribution unit. Air expelled from the overhead duct is downwardly focussed into a columnar stream into an opening of the collection/distribution unit and then dispersed to a work area through the conduit.

Although this document addresses the problems of below floor air delivery, it introduces other problems into the office environment. Specifically, this ventilation system introduces exposed drafts or air currents in the work area. Furthermore, the collection/distribution unit includes a fan that "sucks" air into the unit; this in turn creates a noisy and distractive work environment. In addition, the need to incorporate the collection/distribution unit with the modular furniture unit creates an unsightly addition to the overall office block ambience.

It is an object of the present invention to at least ameliorate the disadvantages and shortcomings of the prior art, or at least provide the public with a useful alternative. Further objects will be evident from the following description.

SUMMARY OF THE INVENTION

In one form, although it need not be the only, or indeed the broadest form, the invention resides in a workstation system comprising:

at least one work area;

at least one partition adjacent the work area;

the partition having a plurality of demountable screens, at least one of the screens having a cavity fluidly connected to at least one aperture in the partition;

a conduit having one end fluidly connected to the cavity and an opposite end fluidly connected to an air duct to communicate air from the air duct to the aperture.

Suitably, the workstation includes a conduit that extends upwardly and fluidly connects an overhead air duct to the aperture. Alternatively, the workstation may include a conduit that extends downwardly and fluidly connects an overhead air duct to the aperture.

Preferably, the work area includes one or more modules that are reconfigurable into multiple configurations.

Suitably, the cavity constitutes a substantial internal volume of the screen. Alternatively, the cavity may be a channel.

The workstation system may be a freestanding structure.

In addition, the apertures may include a diffuser that allows the direction and/or volume of the air to be controlled.

Preferably, the conduit includes a utility channel for receiving utility cabling.

In another form, the invention resides in a method for communicating air to a workstation, the method including:

connecting an air duct to a conduit;

assembling a plurality of demountable screens into a partition, wherein one or more screens include a cavity which are fluidly coupled; and connecting the conduit to at least one cavity.

BRIEF DESCRIPTION OF THE DRAWINGS

In order that the present invention may be readily understood and put into practical effect, reference will now be made to the accompanying illustrations wherein.

DETAILED DESCRIPTION OF THE DRAWINGS

Figure 1:
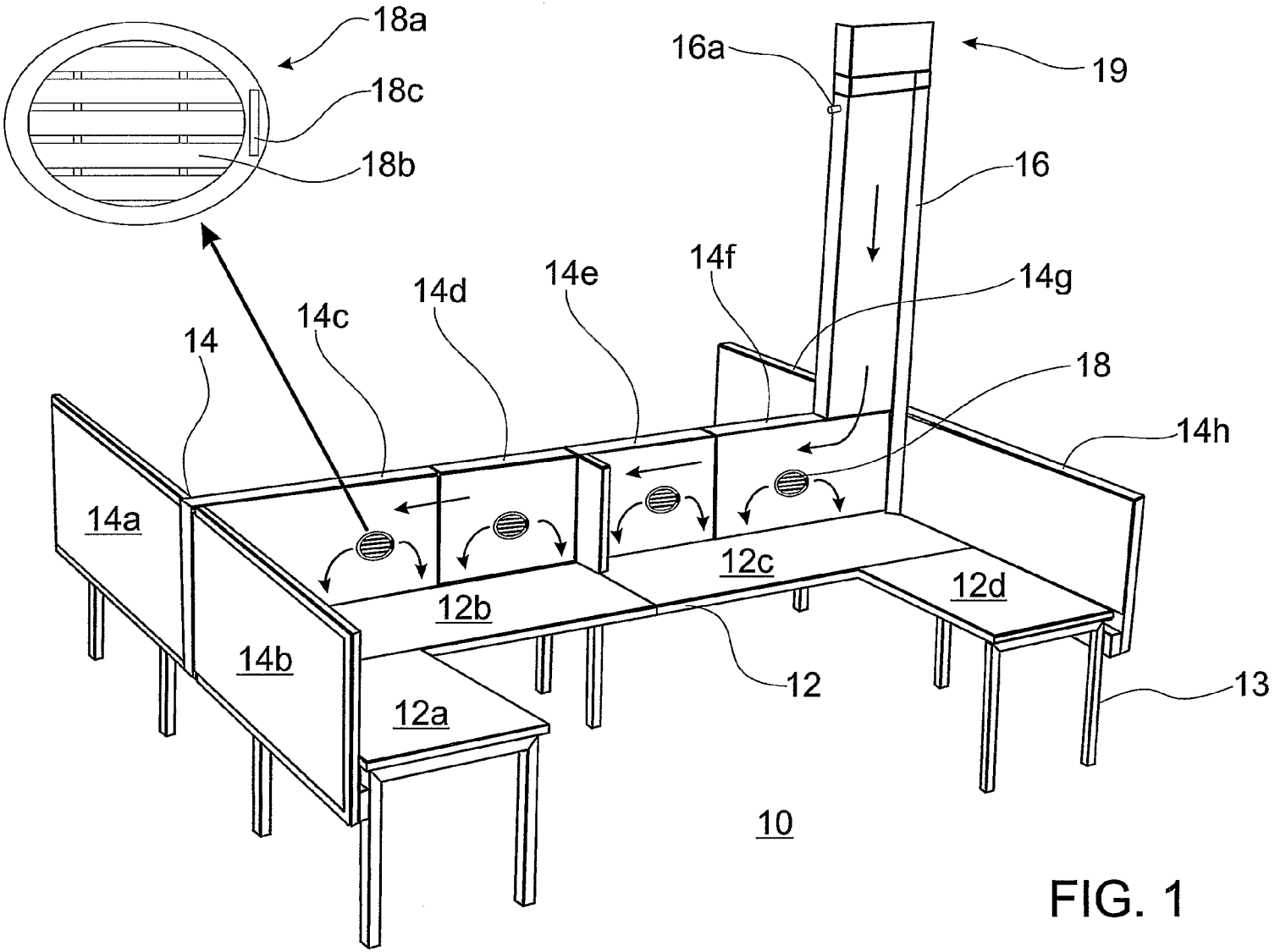
FIG. 1 is a perspective view of a workstation system according to one embodiment of the invention.

FIG. 1 shows a workstation system 10 according to an embodiment of the invention. The workstation system 10 comprises a work area 12, a mounting frame 13, a substantially vertical partition 14 and an upwardly extending conduit 16.

The work area 12 comprises a number of modules that are interconnected. Modules 12*a*, 12*b*, 12*c* and 12*d* are substantially horizontal planar surfaces that constitute the work area 12. The modules 12*a*-12*d* are fastened together such that a vertical face of one module abuts a vertical face of an adjacent module. As a person skilled in the art can appreciate, modules 12*a*-12*d* can be fastened using conventional means such as brackets, clamps and the like. Modules 12*a*-12*d* are manufactured from medium density fibre (MDF) with a laminated finish on the upper and vertical faces. It would be apparent to a person skilled in the art that modules 12*a*-12*d* can be manufactured from a number of other materials and into configurations and sizes that cater to a particular workstation design.

The mounting frame 13 supports the work area 12 and the partition 14. The mounting frame 13 can be manufactured from one or a combination of rectangular hollow sections (RHS), square hollow sections (SHS) and cylindrical hollow sections (CHS).

The partition 14 comprises a number of screens that interconnect. Screens 14*a*, 14*b*, 14*c*, 14*d*, 14*e*, 14*f*, 14*g* and 14*h* constitute the partition 14. Screens are configured in partition groups. As illustrated in FIG. 1, screens 14*a* and 14*b* form one partition group, screens 14*c*, 14*d*, 14*e* and 14*f* form another partition group, and screens 14*g* and 14*h* form yet another partition group.

Each screen 14*a*-14*h* is secured to the mounting frame 13 and is positioned such that each screen 14*a*-14*h* abuts the outer perimeter of work area 12. Alternatively, each screen 14*a*-14*h* is secured to the work area 12. Each screen 14*a*-14*h* comprises a metallic frame securing two resilient panels. Examples of materials used for panels include acrylic, metallic or laminate. Preferably, materials such as fabric, foam, MDF or other absorbing properties are not used in screens 14*a*-14*h* given their condensation properties. Screens 14*a*-14*h* can include fasteners for attaching accessories onto the partition 14. Examples of such accessories include shelves, a white board and a pin-board.

Partition 14 includes apertures 18. Diffusers 18*a* are incorporated in the apertures 18 to allow an occupant at the workstation 10 to control the direction and/or volume of air-flow emanating from the aperture 18. The diffusers 18*a* include a number of slats 18*b* and a lever 18*c* to control the direction and/or volume of air-flow emanating from the aperture 18. Whilst the diffuser 18*a* is an oval shape, other configurations such as rectangular or circular can also be implemented.

The workstation 10 is designed so that each aperture 18 emanates a set rate of 10 liters/second of air with two apertures 18 allocated to each occupant at the workstation 10. Ideally, each occupant receives up to 20 liters/second of air. Hence, if four apertures 18 were used for a particular designated area or occupant, each aperture 18 would emanate 5 liters/second. As a person skilled in the art would appreciate, these air-flow amounts can assist in gaining "Credits" in the "Green Star" Environmental Rating System for an office building (Green Building Council of Australia; www.gbcaus.org).

The conduit 16 fluidly connects an air duct 19 of a climate control system to the partition 14. In other embodiments, the conduit 16 fluidly connects an air duct junction box (not shown) having a baffle to regulate air into the conduit 16. A flexible tube (not shown) fluidly connects the junction box to the air duct 19. The conduit 16 also includes a nipple 16*a*, which allows internal air pressure of the conduit 16 to be measured. The nipple 16*a* is configured to couple an air pressure gauge for measuring the internal air pressure of the conduit. Although the nipple 16*a* is located on the conduit 16, a person skilled in the art can appreciate that the nipple 16*a* can be located in a number of locations on the workstation 10. For example, the nipple 16*a* can be located on the underside of the partition 14.

When the workstation system 10 is installed, air within the air duct 19 flows down the conduit 16 and through the screens 14*c*-14*f*. Internal openings (FIG. 2) of screens 14*c*-14*f* allow air to flow continuously throughout the partition 14. In another embodiment, the workstation 10 can be configured to allow air to flow through sections 14*a*-14*b* and sections 14*f*-14*g* or any other combination thereof.

Although the workstation 10 in FIG. 1 is configured in an H-shape configuration, a person skilled in the art can appreciate that the workstation 10 can be reconfigured into a number shapes and configurations. For example, the workstation 10 may be configured without screens 14*a*, 14*b* and screens 14*g*, 14*h*.

Figure 2:
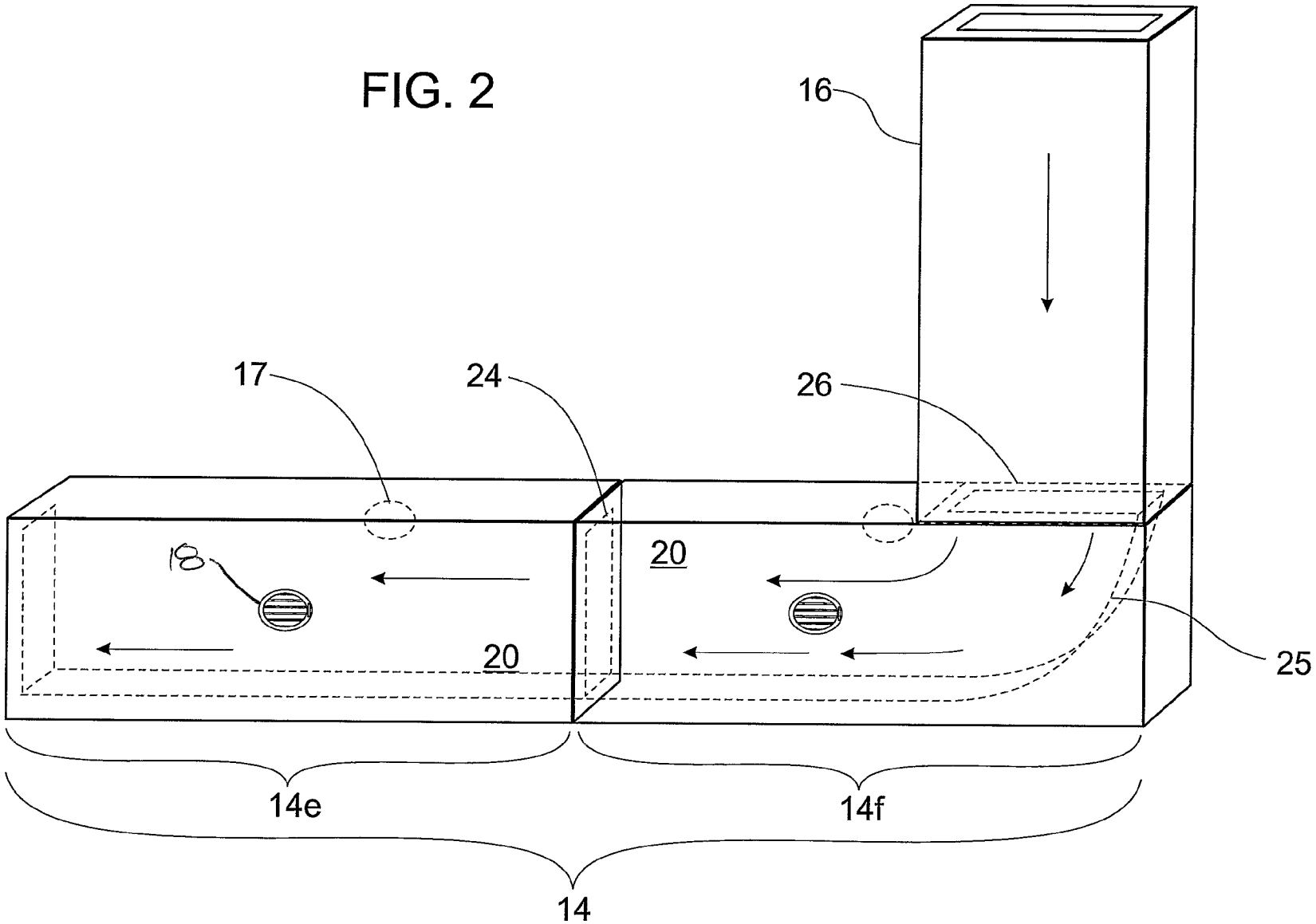
FIG. 2 is a partial cross-sectional view of a partition and a conduit of FIG. 1.

FIG. 2 shows a partial cross-sectional view of conduit 16 and partition 14 of FIG. 1. The partition 14 comprises a first screen 14*f* and a second screen 14*e* and a connection assembly 24.

Screens 14*f*, 14*e* include a cavity 20. The cavity 20 occupies a substantial internal volume of each screen 14*f*, 14*e* such that the screens 14*f*, 14*e* are substantially hollow. Alternatively, the cavity 20 can be a channel and only occupies minimal volume within screens 14*f*, 14*e*. Each cavity 20 is fluidly linked to a cavity of an adjacent screen through the connection assembly 24.

The conduit 16 is coupled to the first screen 14*f*. The conduit 16 has an internal profile that substantially matches an opening 26 on the upper peripheral edge of the first screen 14*f*. Air directed down the conduit 16 into the first screen 14*f* is deflected into a substantially horizontal direction by an air deflector 25. The air deflector 25 is located at the perpendicular intersection of the conduit 16 and lower horizontal portion of the first screen 14*f*. In addition to re-directing the air-flow, the air deflector 25 also assists in minimising turbulence (i.e. eddies) within the partition 14.

The second screen 14*e* is coupled to the first screen 14*f* by the connection assembly 24. The connection assembly 24 includes an opening that substantially matches that of opening 26 of the first screen 14*f*. As such, air-flow travelling in a horizontal direction of the first screen 14*f* continues to flow in the second screen 14*e*. As a person skilled in the art would appreciate, all connections between screens, partitions and conduits are sealed to prevent any substantial air leakage.

Apertures are arranged on both sides of the partition 14. One set of apertures 18 are arranged one side of the partition 14 at one horizontal height. A second set of apertures 17 on the opposite side of the partition 14 arranged at second horizontal height. This stepped arrangement between the sets of apertures 17, 18 allows effective and efficient air-flow throughout the partition 14. In addition, this stepped arrangement ensures consistent air-flow emanating from each set of apertures and minimises any air turbulence (i.e. eddies) within the partition 14 and screens.

In another arrangement, the first set of apertures 18 are laterally offset (i.e. either to the right or to the left) when compared to the corresponding apertures of the second set of apertures 17. This lateral staggered arrangement also provides consistent air-flow from each aperture and minimises any air turbulence in the partition 14.

Figure 3:
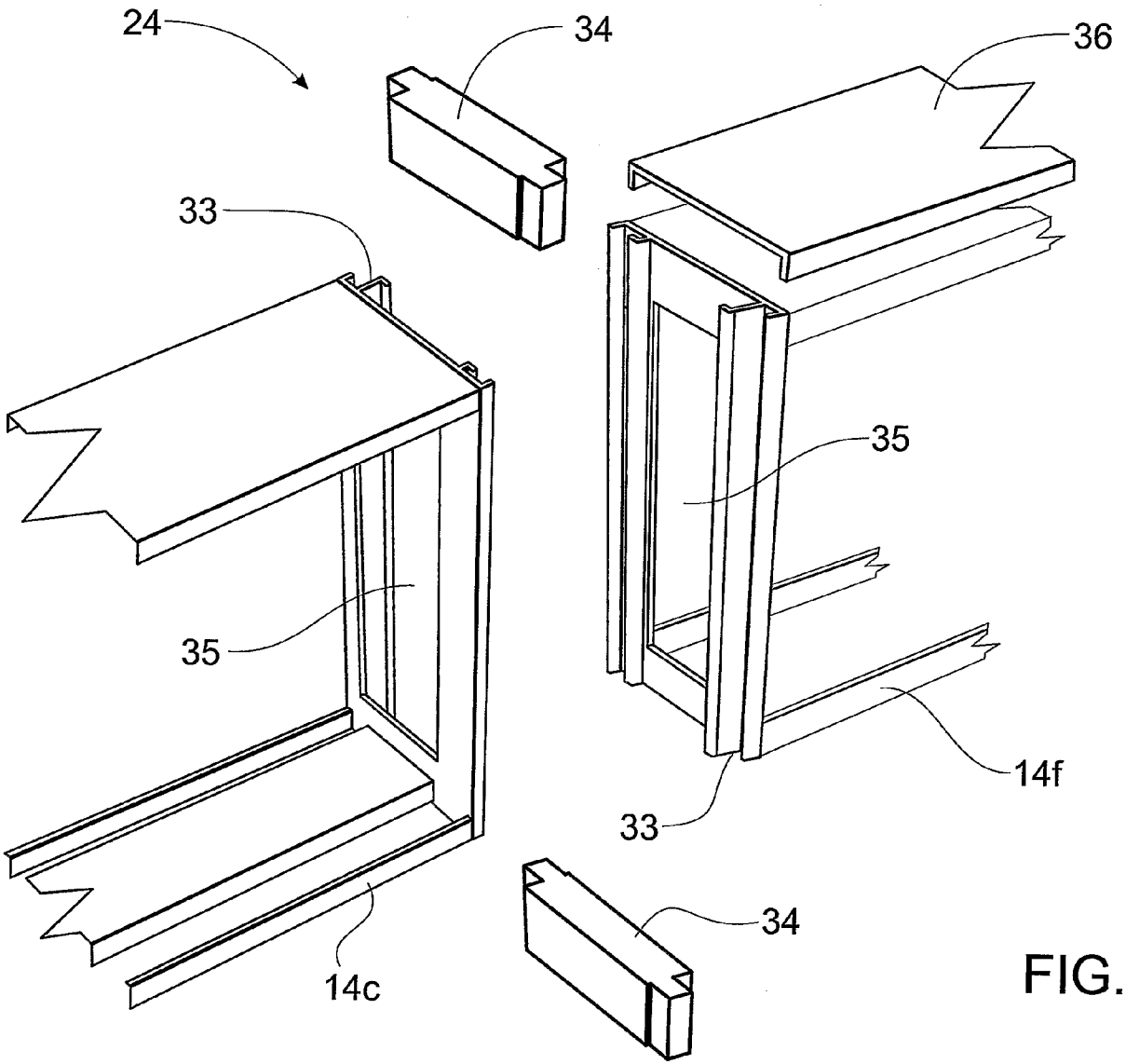
FIG. 3 is a partially exploded perspective view of two connected screens of FIG. 2.

FIG. 3 provides a partially exploded view of a connection assembly 24 between first screen 14*f* and second screen 14*e* of a partition 14 of FIG. 2. The first screen 14*f* and the second screen 14*e* include an extruded partition connector 33 which mates with the opposite (inverted) partition connector 33. Two seals 34 are adhered adjacent the opposite ends of openings 35 and provide a fluid seal in the connection assembly 24. Preferably, the seal 34 is dense yet compressible and allows the partition connectors 33 to engage while providing a fluid seal in the connection assembly 24. Suitable materials for the seal 34 include foam, rubber and non-pvc plastics. Alternatively, a gasket can surround openings 35 and provide a fluid seal. When the partition connectors 33 are engaged, a partition cover 36 can be placed over the connection region by either clipping or sliding over the first screen 14*f* and the second screen 14*e* of the partition 14.

Figure 4A:
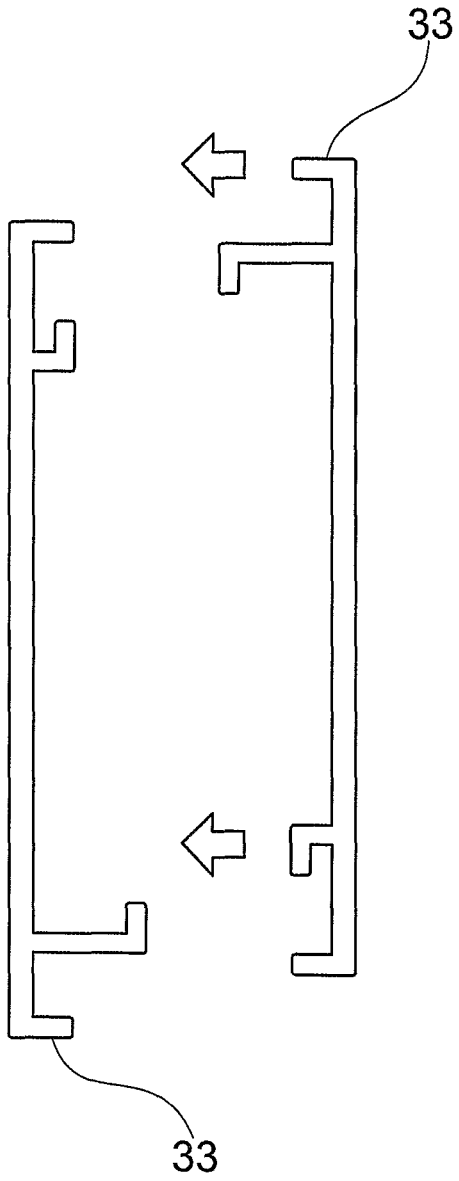
FIG. 4 is a sectional view of a partition connectors of FIG. 3.
Figure 4B:
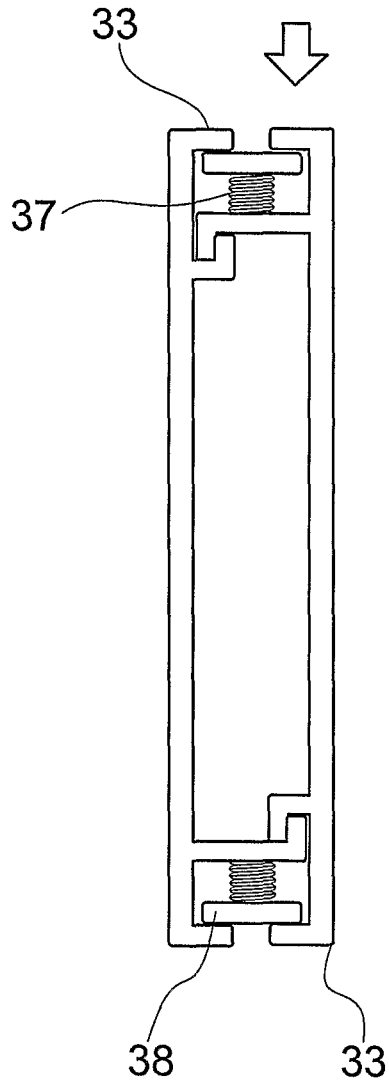

FIGS. 4*a* and 4*b* provide a cross-sectional view of the partition connectors 33 of FIG. 3. The profiles of the two partition connectors are identical, but are inverted with respect to the other. When connected, a grub screw 37 and grub screw nut 38 are used on both sides to further secure the partition connectors 33. It would be apparent that other methods of connecting screens could be effectively implemented in the present invention.

Figure 5:
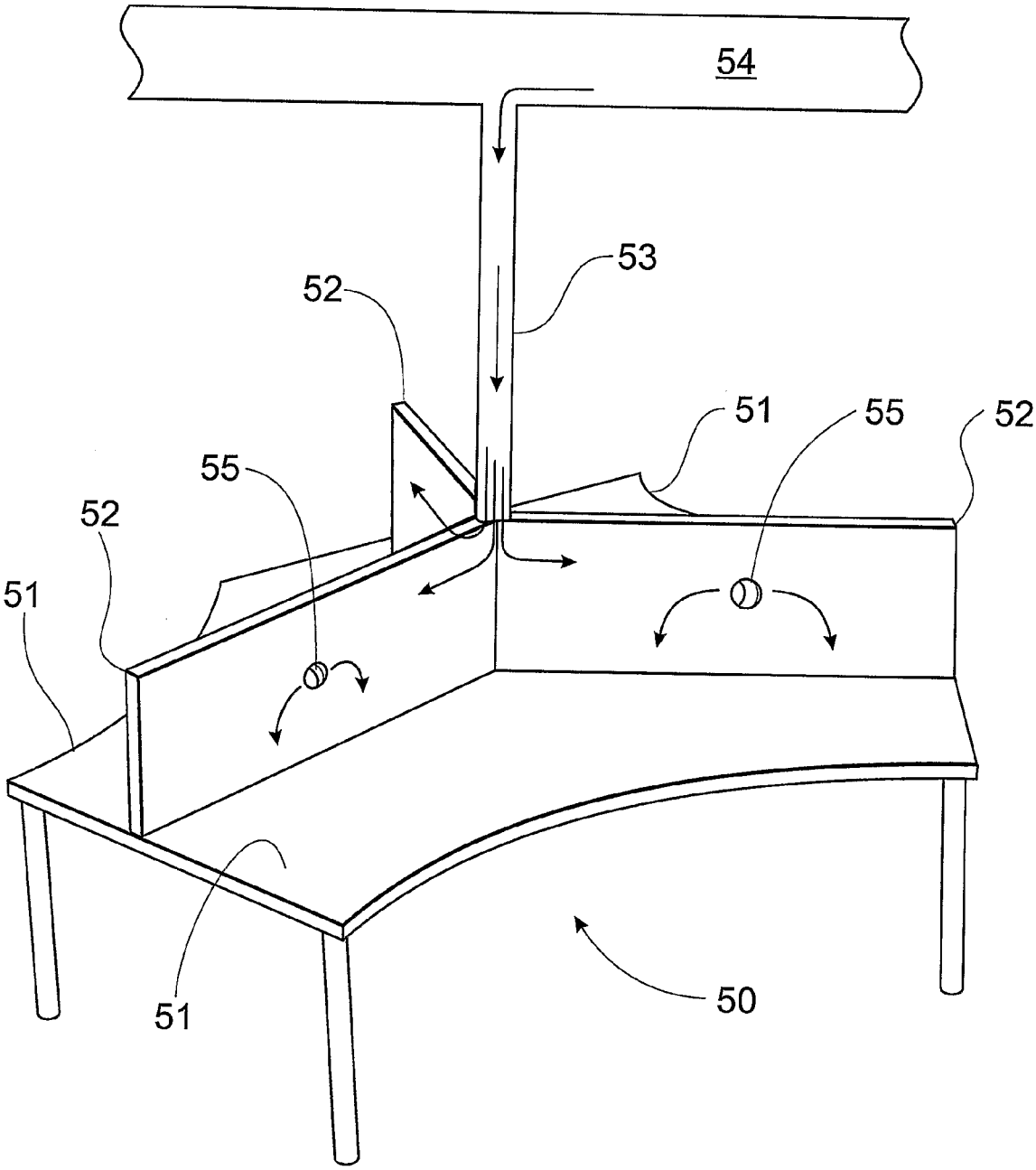
FIG. 5 is a perspective view of the workstation system according to another embodiment of the invention.

FIG. 5 shows a 3-way pod workstation 50 according to another embodiment of the invention. The workstation 50 comprises three work areas 51, three partitions 52 and a conduit 53. The partitions 52 form a Y-shape configuration (when viewed from above) with the conduit 53 located at the intersection of the three partitions 52. To provide a symmetrical appearance, the conduit 53 has a triangular cross-section with each face of the conduit 53 abutting a lateral edge of each of the partitions 52. Other embodiments of invention can include the conduit 53 configured in a cylindrical or an oval cross sections. The opposite end of the conduit 53 is fluidly connected to an air duct 54 located adjacent a ceiling. It would be apparent to a person skilled in the art, the partitions 52 and the conduit 53 are connected by implementing an assembly similar to the connection assembly 24 (FIG. 3). As such, air from the air duct 54 flows down into the partitions 52 and out of apertures 55. Although this embodiment illustrates a 3-way pod workstation, it will be appreciated that other embodiments of the invention can include alternative number of pods, for example a 4 or 5-way pod workstation.

Figure 6:
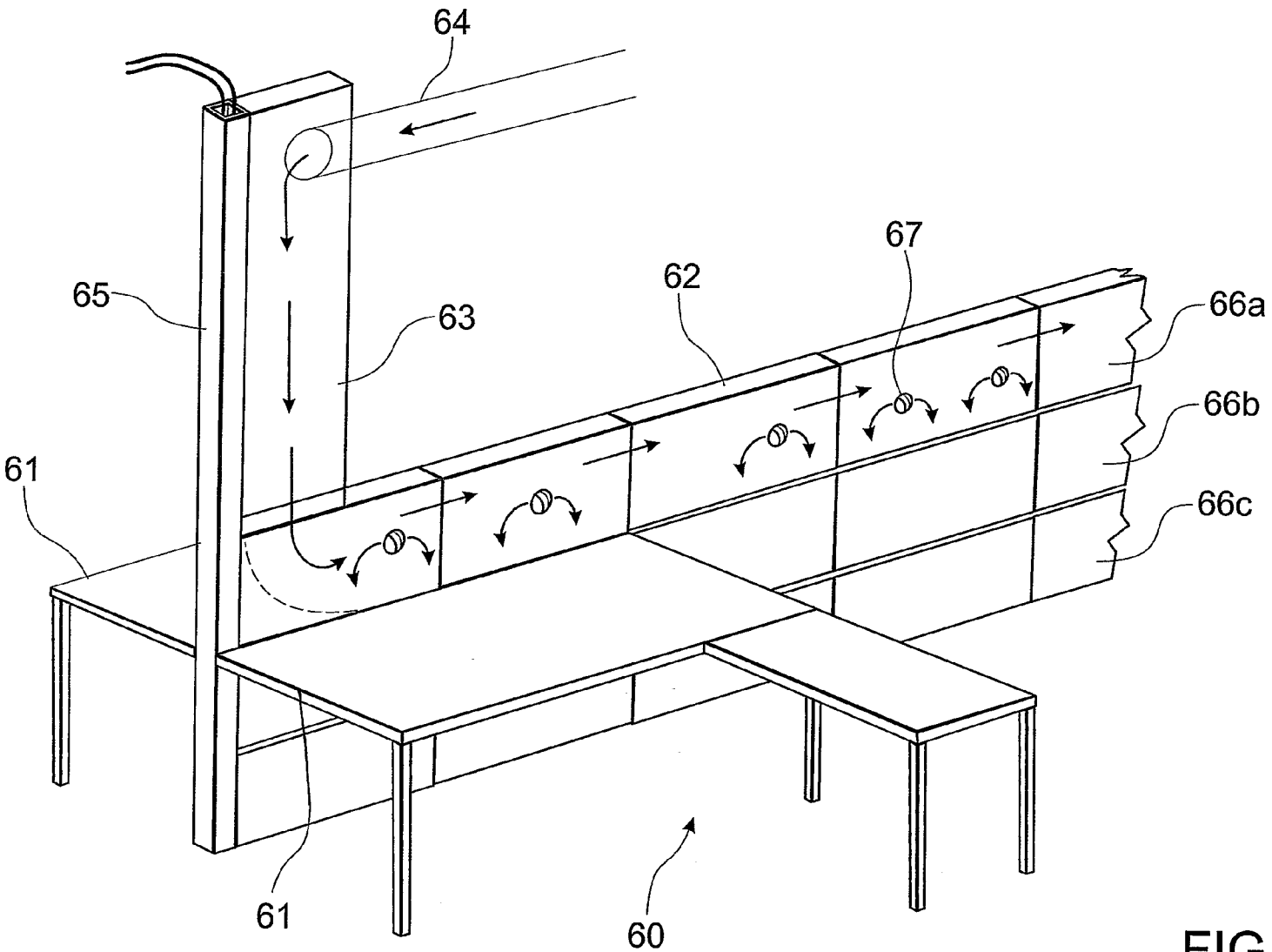
FIG. 6 is a perspective view of the workstation system according to another embodiment of the invention.

FIG. 6 shows a workstation 60 according to another embodiment of the invention. The workstation 60 comprises a partition wall 62, two work areas 61 and a conduit 63.

The partition wall 62 is configured in a series of screens 66*a*, 66*b* and 66*c* arranged in rows and columns. The partition wall 62 is configured from the floor to above the work areas 61. Although FIG. 6 illustrates an air-flow from an air duct 64 down the conduit 63 and along the top row (screen 66*a*) and emanating from apertures 67, it can be appreciated that the invention can be reconfigured to allow air-flow in either the middle row (screen 66*b*) or lower row (screen 66*c*) of partition 62, or any combination thereof.

The conduit 63 includes a utility channel 65. The utility channel 65 allows utility cabling such as electrical and communication cabling to access screens 66*a*, 66*b* and 66*c*. Preferably, the utility cabling access screens in the partition wall 62 that are not utilised for channeling the air-flow. Alternatively, the utility cabling access screens of the partition wall 62 that are utilised for channeling air. Furthermore, separation and reconfiguration of the screens in the partition wall 62 allow for relatively convenient access for maintenance of the utility cabling or installation of utility devices at the workstation 60.

Figure 7:
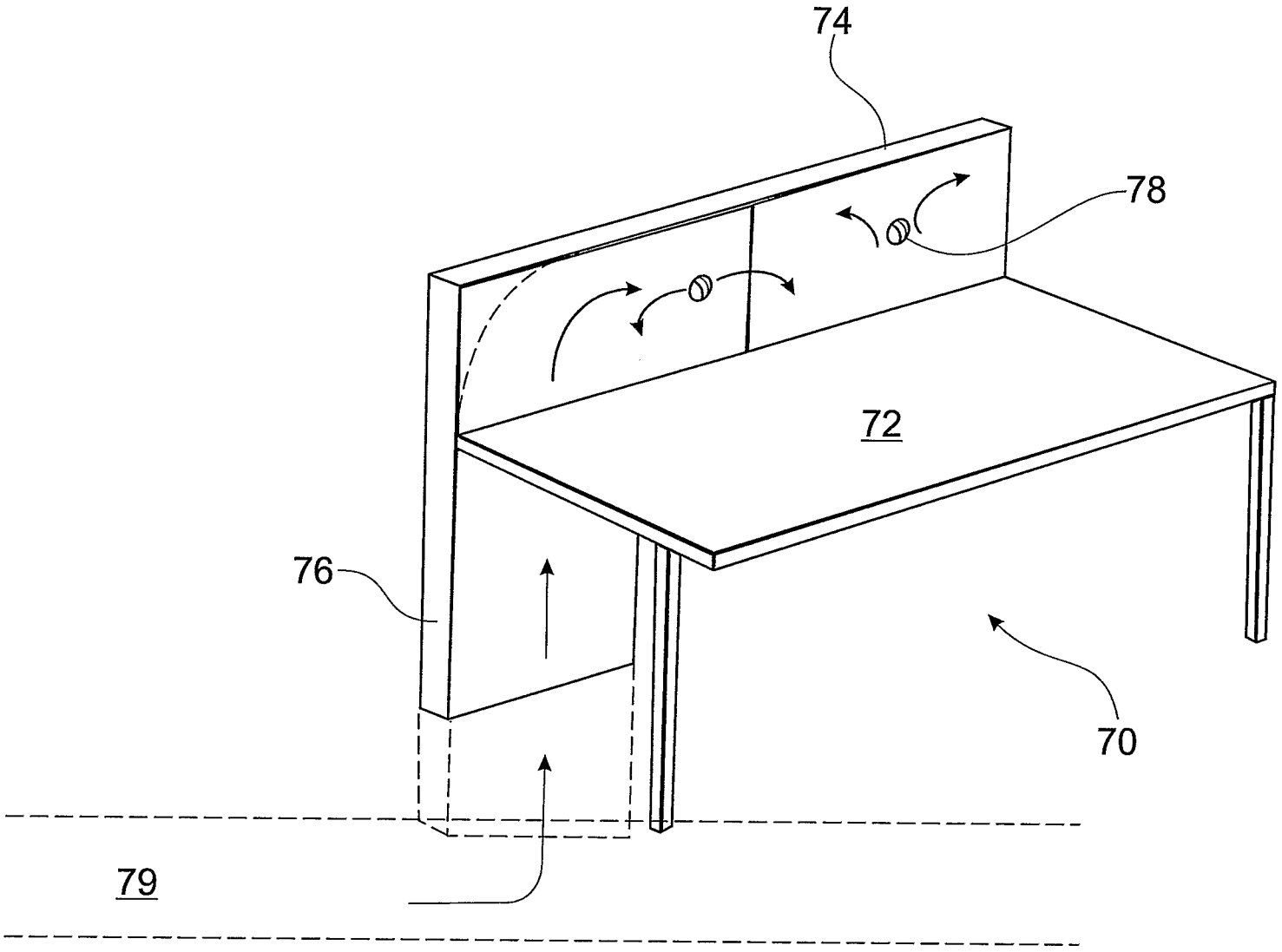
FIG. 7 is perspective view of the workstation system according to another embodiment of the invention.

FIG. 7 illustrates a workstation 70 according to another embodiment of the invention. The workstation comprises a work area 72, a partition 74 and downwardly extending conduit 76.

The conduit 76 is fluidly connected to both a below floor air duct 79, and the internal cavity of the partition 74. Air within the air duct 79 can flow upwardly through the conduit 76 into the hollow partition 74 and out from apertures 78. The work area 72 and the partition 74 are similar to the previously detailed embodiments.

Although the majority of the previously illustrated embodiments referred to implementation of an overhead air duct, a person skilled in the art would appreciate that other embodiments of the workstation can be also be implemented using a below floor air duct 79. Therefore, the advantages as outlined with the earlier embodiments of the present invention with the upwardly extending conduits are also shared with the downwardly extending conduits.

One of the major advantages of the herein described workstation system is its versatility. Each component of the system can be easily connected and dismantled, and the overall system is reconfigurable and retrofitable to suit changing needs of a workstation or office. In addition, permanently fixed Heating Ventilation and Air-Conditioning systems (HVAC's) require minimal adjustments to implement the new workstation system.

Furthermore, the majority of heat that surrounds a workstation originates from devices such as desk-top computers. The herein described new workstation system can facilitate the cooling of both the occupants and devices simultaneously.

Although the embodiments herein described referred to use within the office work area, the workstation system may also be used in open plan manufacturing plants or other open plan work environments with similar results. Furthermore, the herein described invention can be implemented in a free-standing workstation, or into an existing workstation integrated with the existing building:

Throughout the description and claims of this specification, the word "comprise" and variations of that word such as "comprises" and "comprising", are not intended to exclude other additives, components, integers or steps.

Throughout the specification, the aim has been to describe the invention without limiting the invention to any one embodiment or specific collection of features. Persons skilled in the relevant art may realize variations from the specific embodiments that will nonetheless fall within the scope of the invention.

The invention claimed is:

1. A workstation system comprising:

at least one work area;

at least one partition adjacent the work area;

the partition having a plurality of interlocked demountable screens, at least one of the screens having a frame securing at least two panels to form a cavity, the cavity fluidly connecting at least one aperture in the screen with an opening of the frame, the frame having at least one extruded partition connector adjacent the opening that directly interlocks with at least one opposite inverted partition connector, and at least one fluid seal that fluidly seals a space located above and/or below adjacent interlocked screens when the screens are interlocked together; and a conduit having one end fluidly connected to the cavity of a screen and an opposite end fluidly connected to an air duct to communicate air from the air duct to the aperture (s) of the screen.

2. The workstation as recited in claim 1, wherein the one end of the conduit extends upwardly and fluidly connects an overhead it duct to the aperture.

3. The workstation as recited in claim 1, wherein the work area includes one or more modules that are reconfigurable into multiple configurations.

4. The workstation as recited in claim 1, wherein the cavity constitutes a substantial internal volume of the screen.

5. The workstation as recited in claim 1, wherein the cavity is a channel.

6. The workstation as recited in claim 1, wherein a first set of apertures are on one face of the partition and a second set of apertures are on an opposite face of the partition.

7. The workstation as recited in claim 6, wherein the first set of apertures are arranged at one vertical height and the second set of apertures are arranged at a second vertical height.

8. The workstation as recited in claim 6, wherein the first set of apertures are laterally offset when compared to the corresponding apertures of the second set of apertures.

9. The workstation as recited in claim 1, wherein the plurality of screens are configured into a partition wall that extends from a floor to or above the work area.

10. The workstation as recited in claim 1, wherein the aperture includes a diffuser that controls the direction and/or volume of air emanating from the aperture.

11. The workstation as recited in claim 1, wherein the workstation is configured such that one or more apertures emanate air at a regulated amount.

12. The workstation as recited in claim 11, wherein the regulated amount is 20 liters/second of air.

13. The workstation as recited in claim 1, wherein at least one screen includes an air-deflector.

14. The workstation as recited in claim 1, wherein the conduit includes a utility channel for receiving utility cabling.

15. The workstation as recited in claim 1, wherein the one end of the conduit extends downwardly and fluidly connects a below floor air duct to the aperture.

16. The workstation as recited in claim 1, wherein the workstation is a freestanding structure.

17. A method for communicating air to a workstation, the method including:

fluidly connecting an air duct to a conduit;

assembling a plurality of demountable screens including assembling at least one screen by securing at least two panels to a frame to form a cavity, the frame having at least one extruded partition connector adjacent an opening of the frame that connects with at least one opposite inverted partition connector, the opening of the frame being in fluid communication with the cavity;

assembling the plurality of demountable screens into a partition, wherein one or more cavities of one or more demountable screens are directly interlocked by respective partition connectors and fluidly coupled through openings of adjacent frames with at least one fluid seal fluidly sealing a space located above and/or below adjacent interlocked screens; and fluidly connecting the conduit to at least, one cavity.

18. The method as recited in claim 17, wherein the step of fluidly connecting the conduit to at least one cavity includes installing a curved air deflector at an intersection of the conduit and the screen.

19. A workstation system comprising:

A plurality of partitions, the partitions having a plurality of demountable interlocked screens each having a frame securing at least two panels to form a cavity, the cavity fluidly connecting at least one aperture in the screen with an opening of the frame, the frame having an extruded partition connector and an opposite inverted partition connector adjacent the opening that directly interlock with corresponding inverted and extruded partition connectors of a frame of an adjacent screen;

At least one fluid seal that fluidly seals a space located above and/or below adjacent interlocked screens when the screens are interlocked together; and A conduit having one end fluidly connected to the cavity of a screen and an opposite end fluidly connected to an air duct to communicate air from the air duct through openings in the frames to the apertures of the screens.

20. The workstation as recited in claim 1, wherein the work area further includes a curved air deflector located at an intersection of the conduit and the screen.

21. The workstation as recited in claim 1, wherein the frame has complementary male and female mating partition connectors on opposite ends thereof.

22. The workstation as recited in claim 19, wherein said partition connectors constitute complementary male and female mating partition connectors on opposite ends of each frame.

23. The workstation as recited in claim 21, wherein the male connector is constituted by an L-shaped projection and the female connector comprises an L-shaped projection positioned to define an L-shaped recess for receiving the male connector.

24. The workstation as recited in claim 22, wherein the male connector is constituted by an L-shaped projection and the female connector comprises an L-shaped projection positioned to define an L-shaped recess for receiving the male connector.

* * * * *